US005867956A

United States Patent [19]

Gregory, Jr. et al.

[11] Patent Number: 5,867,956

[45] Date of Patent: Feb. 9, 1999

[54] INTEGRAL ROOF VENTILATION BAFFLE AND INSULATION

[76] Inventors: Stephen E. Gregory, Jr., 2951 Laurentide Dr., Ann Arbor, Mich. 48103; Donald G. Wheatley, 4451 Ford Rd., Ann Arbor, Mich. 48105

[21] Appl. No.: 488,882

[22] Filed: Jun. 9, 1995

[51] Int. Cl.[6] ..... E04C 1/00

[52] U.S. Cl. ..... 52/309.13; 52/404.1; 428/167; 428/172

[58] Field of Search ..... 52/95, 22, 199, 52/302.1, 302.3, 302.4, 302.7, 404.1, 404.2, 404.3, 450, 309.13, 309.14, 309.4; 454/185, 260; 428/167, 172

[56] References Cited

U.S. PATENT DOCUMENTS

| | | | |
|---|---|---|---|
| 27,872 | 4/1860 | Walcott | 52/302.3 |
| 709,257 | 9/1902 | Cottrell | 52/404 |
| 960,554 | 6/1910 | Jennings | 52/456 |
| 1,963,609 | 6/1934 | Balduf et al. | 20/4 |
| 2,308,942 | 1/1943 | Teasdale | 52/450 |
| 2,405,116 | 8/1946 | Cullen | 52/22 |
| 3,797,180 | 3/1974 | Grange | 52/95 |
| 3,884,009 | 5/1975 | Frohlich et al. | 52/302.1 X |
| 3,972,164 | 8/1976 | Grange | 52/95 |
| 4,102,092 | 7/1978 | Ward | 52/95 |
| 4,254,598 | 3/1981 | Rugroden | 52/199 |
| 4,406,095 | 9/1983 | Slavik | 52/95 |
| 4,446,661 | 5/1984 | Jonsson et al. | 52/95 |
| 4,655,018 | 4/1987 | Pardo | 52/302.3 |
| 4,706,421 | 11/1987 | Thompson | 52/95 X |
| 4,977,714 | 12/1990 | Gregory et al. | 52/95 |
| 5,069,950 | 12/1991 | Crookston | 52/199 X |
| 5,092,225 | 3/1992 | Sells | 52/199 X |
| 5,330,814 | 7/1994 | Fewell | 428/41 |
| 5,341,612 | 8/1994 | Robbins | 52/302.3 X |
| 5,369,926 | 12/1994 | Borland | 52/309.4 X |
| 5,421,133 | 6/1995 | Berdan, II et al. | 52/404.1 |
| 5,425,672 | 6/1995 | Rotter | 52/199 X |
| 5,473,847 | 12/1995 | Crookston | 52/95 X |
| 5,596,847 | 1/1997 | Stephenson | 52/95 X |

FOREIGN PATENT DOCUMENTS

| | | | |
|---|---|---|---|
| 2583091 | 12/1986 | France | 52/302.4 |
| 2806988 | 8/1979 | Germany | 52/302.3 |
| 3623281 | 1/1988 | Germany | E04B 1/74 |

*Primary Examiner*—Michael Safavi
*Attorney, Agent, or Firm*—James M. Deimen

[57] ABSTRACT

A ventilated insulation bat having longitudinal channels formed in the top of the bat. The channels are resiliently compressible and flattenable when the bat is rolled, but the channels resume their depth when the bat is unrolled. The channels are manufactured by means for forming such as by molding or melting the channels into the bat or by affixing a flattenable perforated corrugated device to the bat. The transverse distance across the flattenable perforated corrugated device extends less than the width of the bat. The flattenable device when flattened is smaller than the bat to prevent the device from extending beyond the width of the bat when the bat is compressed and rolled into a roll for storage or transportation.

3 Claims, 1 Drawing Sheet

INTEGRAL ROOF VENTILATION BAFFLE AND INSULATION

BACKGROUND OF THE INVENTION

The field of the invention pertains to roof insulation and ventilation. In particular, the invention pertains to an integral roof ventilation baffle and insulation apparatus. Fiberglass bats are used to insulate the undersides of roofs. However, ventilation must be provided for or the effective insulation value of the bats is reduced by trapped moisture. Heretofore, baffling devices have been installed at the construction site necessitating additional construction time and extra tools to be used. An example of a baffling device installed at the construction site prior to positioning the insulation bat is discussed in U.S. Pat. No. 4,977,714.

A variety of other devices for providing means to provide a roof ventilation baffle are disclosed in U.S. Pat. No. 4,254,598; U.S. Pat. No. 4,446,661; U.S. Pat. No. 3,797,180 and German Patent Document DE3623281, however, these baffles are all separate elements from the roof insulation. Thus, no known apparatus exists to facilitate the easy provision of ventilation channels to insulation materials prior to installation.

SUMMARY OF THE INVENTION

The invention comprises a roof ventilation baffle having an insulation bat associated therewith and is a further improvement on the device shown in U.S. Pat. No. 4,977,714 to one of the applicants herein. This patent is incorporated by reference in this application. The top of the insulation bat fits against the underside of the roof. The top of the insulation bat has ventilation baffles formed therein at the manufacturer prior to delivery to the construction site. The ventilation baffles are comprised of perforated corrugations affixed to the top side of the bat. Paper or plastic comprises the material for the perforated corrugations.

Alternatively, the top side of the fiberglass bat can be formed into channels by melting some of the fiberglass material away from the top side of the bat. The advantage in providing the integral baffles to the insulation bats is that during shipping the baffles can flatten yet the baffles have sufficient resiliency to regain their shape and the necessary depth to function as ventilation channels for air passage after being unrolled for installation. Thus, the insulation bats can be compressed for shipment and expanded for installation in the same manner as conventional insulation bats.

Thereby, ventilation channels are provided in the bats without an extraneous work element being required by the installers. This is particularly desirable during installation in a hot enclosed attic with prickly fiberglass fibers floating about.

DESCRIPTION OF THE PREFERRED EMBODIMENT.

Figure 1:
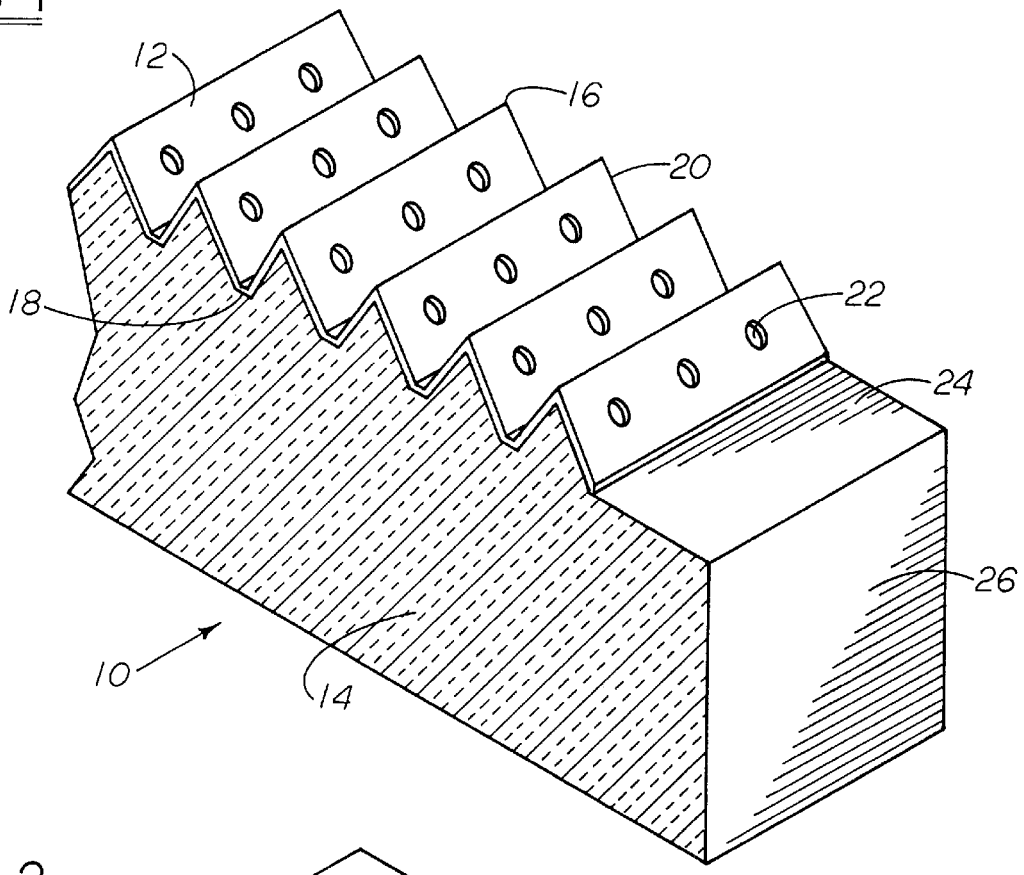
FIG. 1 illustrates a perspective view of the invention showing in cross-section a perforated corrugated device affixed to an insulation bat.

In FIG. 1, a section of an insulation bat generally denoted as 10 is thereshown. The insulation bat 10 comprises a flattenable perforated corrugated device 12 permanently affixed to the body 14 of insulating material such as fiberglass. Ideally, the corrugated device 12 and body 14 are flattenable yet resilient to allow lateral flattening of the corrugated device on the body 14 when the bat 10 is compressed and rolled, but thereafter when the bat is unrolled, the resiliency allows the flattened corrugated device to resume its preroll configuration of distinguishable ridges. The flattenable perforated corrugated device 12 in its unflattened configuration has peaks 16 and valleys 18 creating corrugations 20 across the device 12. The corrugations 20 are placed to run longitudinally on the body 14 of insulating material. Perforations 22 are provided in the corrugations to allow any moisture in the bat to pass into the ventilating channel.

The corrugated device 12 when affixed to the body 14 and unflattened extends only partially across the width of the top side of the body. Thus, a small portion 24 of the body 14 extends widthwise beyond the device. This allows for the expansion of the corrugated device in a transverse direction or distance when the corrugated device is flattened. Thus, the room for transverse expansion prevents the corrugated device 12 when in its flattened rolled state from extending beyond the sides 26 of the rolled bat.

Figure 2:
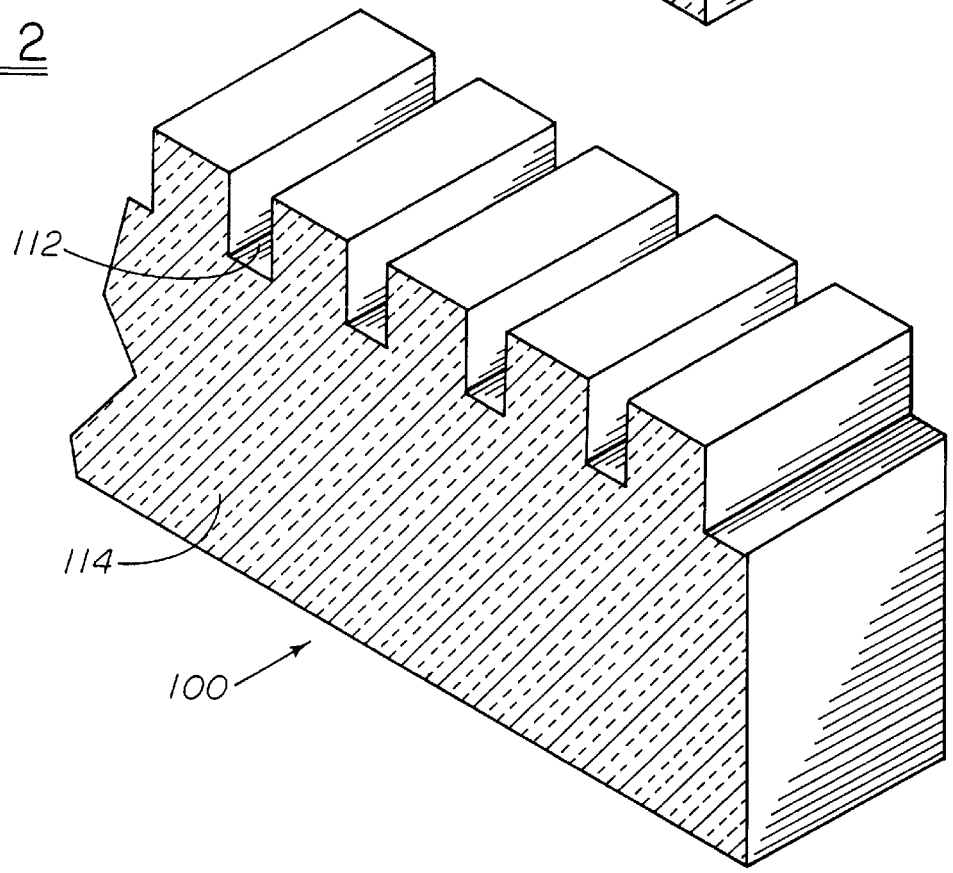
FIG. 2 illustrates a perspective view of an alternate embodiment of the invention showing in cross-section ventilation channels formed therein.

Alternatively and as shown in FIG. 2, the insulation bat 100 comprises channels 112 formed into the material of the body 114 itself. The channels 112 are envisioned to be longitudinal channels. The channels 112 can be fabricated by various means for forming i.e., manufacturing processes such as by molding when forming the bat or by melting the bat material away to form the channels 112 once the bat 114 is formed. In the instance when the channels 112 are formed by molding at the time the bat itself is formed, the mold into which the insulating material is placed contains means to mold the channels into the bat. The embodiment of FIG. 2 can be practiced with compressible insulation such as fiberglass bats or rigid insulation such as Styrofoam® planks.

In use, the top side of the bat having either the channels formed therein or the channels created by the corrugations of the corrugated device affixed thereto is placed against the underside of a roof and the bat affixed to the roof in any conventional manner. Ventilation channels are thereby developed that direct air and moisture to roof vents (not shown) for disposition to the atmosphere external of the structure.

Both the above-described ventilation and insulation bats achieve needed ventilation when the bats are in their installed position. As the bats are formed at the time of manufacture, the installation process on site is simplified requiring less work time and fewer tools. From the insulation installer's perspective, the less time spent in the airborne presence of fiberglass fibers is attractive, particularly if the environment is a hot and humid small attic space.

We claim:

1. An apparatus for ventilating and insulating comprising a bat of insulating material having resiliently compressible ventilating channels formed therein, the resiliently compressible ventilating channels comprising a perforated corrugated device affixed to the bat of insulation material, the resiliently compressible ventilating channels being collapsible and flattenable and the channels resiliently resuming the preflattened shape of the perforated corrugated device when unflattened.

2. The apparatus according to claim 1 wherein the bat has a top side, the top side having a width from a first edge to a second edge and the perforated corrugated device having a transverse distance from one edge to the other edge of the perforated corrugated device, the perforated corrugated device being affixed to the top side of the bat between the first edge and the second edge, the transverse distance of the perforated corrugated device being less than the width of the top side when the bat is in an unrolled orientation.

3. The apparatus according to claim 2 wherein the transverse distance of the perforated corrugated device when the bat is unrolled is less than the transverse distance of the perforated corrugated device when the bat is rolled.

* * * * *